United States Patent [19]

Smiley

[11] Patent Number: 4,478,267

[45] Date of Patent: Oct. 23, 1984

[54] DOOR HINGING ASSEMBLY FOR SLIDING GLASS DOOR STRUCTURE

[76] Inventor: Raymond E. Smiley, 12 Yeger Rd., Cranbury, N.J. 08512

[21] Appl. No.: 422,855

[22] Filed: Sep. 24, 1982

[51] Int. Cl.[3] ..... E06B 3/32

[52] U.S. Cl. ..... 160/97; 160/91

[58] Field of Search ..... 160/89–92, 160/96, 97; 49/168

[56] References Cited

U.S. PATENT DOCUMENTS

| | | | |
|---|---|---|---|
| 2,585,118 | 2/1952 | Hansen | 160/91 |
| 2,970,642 | 2/1961 | Parsons | 160/91 |
| 3,291,192 | 12/1966 | Jones, Jr. | 160/91 |
| 3,654,733 | 4/1972 | Blackwell | 49/168 |
| 3,710,839 | 1/1973 | Andres | 160/91 |
| 4,330,021 | 5/1982 | Deering | 160/91 |

*Primary Examiner*—Peter M. Caun

*Attorney, Agent, or Firm*—Raymond E. Smiley

[57] ABSTRACT

An apparatus for adapting a sliding screen door for hingable mounting to a sliding glass door structure includes a pair of hinges mounted to one side of the screen door and to one side of a fixed door panel of the sliding glass door structure permitting the screen door to assume a position closed against the sliding glass door structure frame or away therefrom. A filler strip is positioned between the fixed door panel and hinged side of the screen door to provide an insect tight seal therebetween.

10 Claims, 5 Drawing Figures

FIG. 1
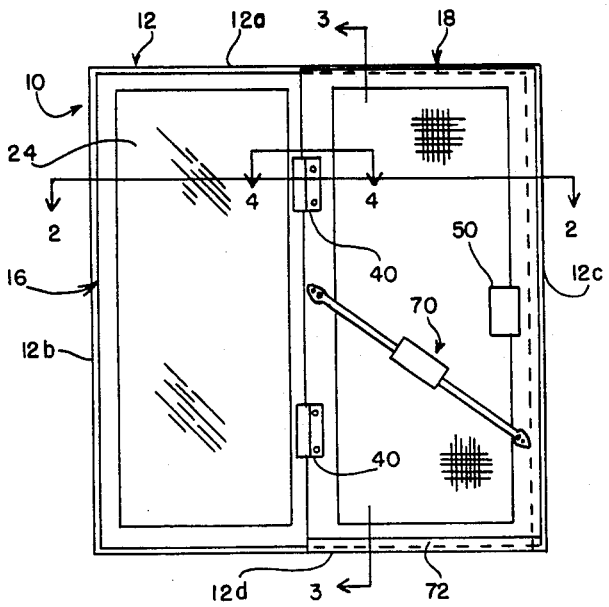
FIG. 3
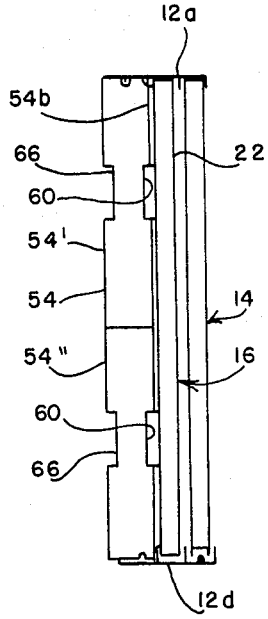
FIG. 2
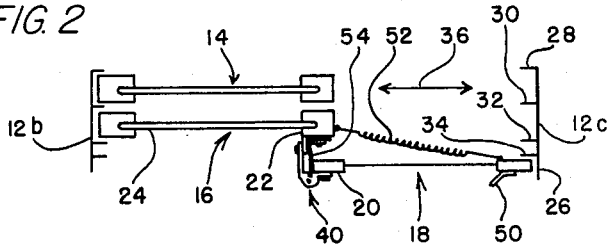
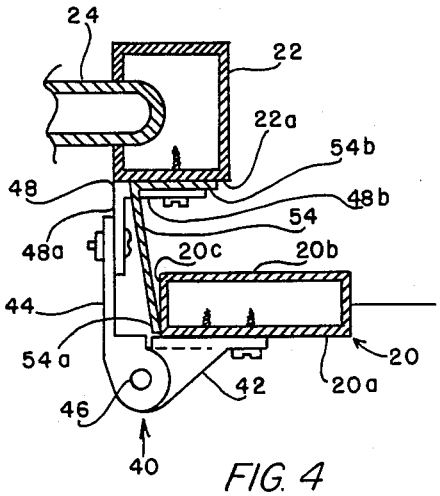
FIG. 4
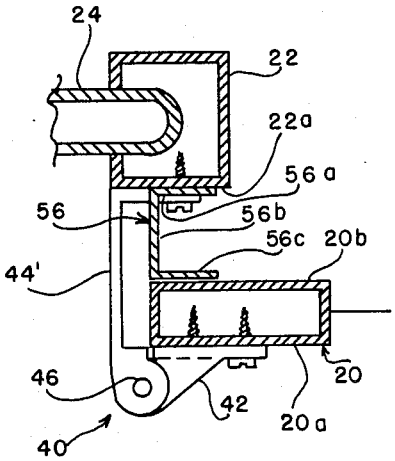
FIG. 5

DOOR HINGING ASSEMBLY FOR SLIDING GLASS DOOR STRUCTURE

BACKGROUND OF THE INVENTION

This invention relates to an assembly for mounting of a screen door in a sliding glass door structure and more particularly to the hinged mounting of such screen door.

Shortly after the sliding glass door structure was invented the sliding screen door for use with the sliding glass door structure was invented. The purpose of the screen door is to keep insects, animals and the like from traversing the void left by the open glass door. Shortly after the first screen door was installed the first child to use the door must have decided that it was more fun to open the screen door than to close it. At about the same time the first adult to use the door must have discovered that a sliding screen door seems to spend more time off the track of the sliding glass door stucture than on it. Although quality sliding glass door structures, not possessing the last mentioned deficiency, are available the average builder installed sliding glass door screen slides only with difficulty on its track leading to the above-mentioned problems. The past solution has been to keep the glass door closed thereby defeating the purpose of the door.

SUMMARY OF THE INVENTION

In accordance with a preferred embodiment of the invention an apparatus for adapting a screen door for hinged mounting to a sliding glass door structure wherein the structure comprises a frame including at least one guide track and first and second glass door panels. The first panel is slidable in the track. The second panel is fixed relative to the frame and parallel to the track when operative. The apparatus comprises, in combination, means adapted for attachment to the screen door and second door panel for permitting the screen door to pivot relative to the second door panel between a first position abutting the frame and a second position removed therefrom. The combination further includes means for substantially sealing any gap between the second door panel and the screen door when the screen door is in the first position.

BRIEF DESCRIPTION OF THE DRAWING

FIG. 1 is an elevation view of a sliding glass door structure including a hinged screen door in accordance with a preferred embodiment of the invention;

FIG. 2 is a cross section plan view along lines 2—2 of FIG. 1;

FIG. 3 is a cross section elevation view along lines 3—3 of FIG. 1 with some components left out for drawing clarity;

FIG. 4 is a cross section view along lines 4—4 of FIG. 1 illustrating to enlarged scale a portion of the screen door hinging mechanism; and FIG. 5 is a cross section view along lines 4—4 of FIG. 1 illustrating an enlarged version of an alternative embodiment of a hinging mechanism.

DESCRIPTION OF THE PREFERRED EMBODIMENT

In the various figures like reference numerals refer to like elements. Where a particular element is best illustrated or only illustrated in a particular figure of several being described that figure will be given in perenthesis.

With reference to the elevation view of FIG. 1 and cross section plan view of FIG. 2 a sliding glass door structure 10 includes a frame 12 and first and second sliding door panels 14 and 16 (FIG. 2). Structure 10 is also known as a patio door. Panel 14, as illustrated, is directly behind panel 16 and therefore not visible in FIG. 1. Sliding glass door structure 10 also includes a screen door 18 which, in a conventional structure, is mounted in a different manner than that illustrated in the various figures.

Typically door panel 16 comprises a door frame 22 surrounding a single or double glass panel 24. Door panel 14 is similarly constructed. Door frame 22 is usually constructed of aluminum or wood. The sliding glass door structure frame 12 is usually comprised of four sections, top section **12*a*, left and right sections 12*b* and 12*c* respectively and bottom section 12*d* (FIG. 1). The frame is usually constructed of extruded aluminum or a combination of some metal and wood for use with aluminum and wood framed doors respectively. Typically frame sections 12*a*, 12*b* and 12*c* are of the same cross section as illustrated for frame sections 12*b* and 12*c* (FIG. 2). Each of the three sections includes a major wall 26 to which are connected at right angles walls 28, 30, 32 and 34 (FIG. 2). In frame section 12*a*, walls 28 and 30 form a track in which door panel 14 slides. Walls 30 and 32 form a track in which door panel 16 slides. Walls 32 and 34 form a track in which screen door 18** slides in the conventional mounting of the screen door, though not as arranged in connection with the present invention.

Frame section **12*d* (FIG. 3) is usually different than the other frame sections 12*a*, 12*b* and 12*c*. FIG. 3 is a cross section view along lines 3—3 of FIG. 1 but with screen door 18 and hinges 40 and members 48 (to be hereinafter described) removed for drawing clarity. Frame section 12*d* typically includes raised rails formed as part of or secured to a base plate on which rollers, (not shown) attached to the door panels 14 and 16 and screen door 18, roll. In the sliding glass door structure in some geographic regions both panels 14 and 16 are adapted to slide as indicated by arrows 36 (FIG. 2) between left frame section 12*b* and right frame section 12*c*. In other geographic regions door panel 16 is permanently positioned as illustrated in FIG. 2 and only door panel 14 slides. However, when the door structure is operative, door panel 16 is fixed against frame section 12*b*, as illustrated in FIGS. 1 and 2, or against frame section 12*c*** (for a left opening door) by means of a locking mechanism (not shown). The disclosure thus far is of a common sliding glass door structure.

In accordance with the invention screen door 18 is positioned, not between track walls 32 and 34 but rather outside wall 34 away from wall 32 (FIG. 2). With reference now to FIG. 4, enlarged in scale relative to FIG. 2, a pair of hinges 40 (one shown in FIG. 4) each comprising a section 42 and a section 44 pivotable relative to one another about hinge pin 46 are attached respectively to frame portion surface **20*a* of screen door frame 20 and leg 48*a* of L shaped member 48. The other leg 48*b* of L shaped member 48 for each hinge is in turn attached to face 22*a* of door 16 frame 22 on the side thereof nearest to frame section 12*c*. Hinge section 42 is attached to frame surface 20*a* and leg 48*b* is attached to frame surface 22*a* by suitable securing means such as self tapping screws for an aluminum door or wood screws for a wooden door. One of hinge section 44** or leg 48*a* of member 48 contains one or more elongated slots and the other contains circular openings permitting member 48 and hinge section 44 to be secured together by conventional means in such orientation that surface 20*b* of screen door 20 is positioned just outside a plane passing through walls 34 of frame members 12*b* and 12*c* (FIG. 2).

In some screen door hinging assemblies the exact distance between surface 20*a* of screen door panel 20 and surface 22*a* of sliding door panel 16 is known in which case the alternative hinging arrangement of FIG. 5 may be utilized. In FIG. 5 a hinge section 44′ is similar to hinge section 44 in FIG. 4 except that the hinge section 44′ corresponds to the combination of hinge section 44 and angle 48 in FIG. 4. Hinge section 44′ is sized to space a screen door assembly 20 the proper distance from surface 22*a* of door 16 as described in connection with FIG. 4. With hinges 40 secured to door 20 and door 16, door 18 can be pivoted about the axis of pin 46 to open away from or close against wall 34 by a person engaging handle 50 which is suitably secured to screen door frame 20.

Some form of spring is used to resiliently urge door 18 against wall 34. The spring may be a conventional screen door spring 52 which is attached to screen frame 20 and door 16 or frame 12*a* near door 16. Alternatively the spring can be built into each hinge 40. Such spring hinges are sold by Stanley Hardware, New Britain, Conn., 06050 as model SP158.

When the screen door is installed as described above, there is a gap between frame surface 22*a* and frame surface 20*b* of door 20. Therefore in accordance with the invention a filler piece such as an elongated substantially L shaped filler piece 54 (FIGS. 2 and 4) or U shaped filler piece 56 (FIG. 5) is provided. The filler piece 54 or 56 extends from frame section 12*a* to frame section 12*d*. Filler piece 54 may be made of vinyl, by way of example, and may have a cross section shape slightly less than 90 degrees such as about 80 or 85 degrees so that, when installed, the side 54*a* thereof touches the screen frame 20 to provide an insect free seal. To provide ease in installation, filler piece 54 may be in two sections, an upper half 54′ (FIG. 3) extending to frame section 12*a* and a lower half 54″ (FIG. 3) extending to frame section 12*d*. To provide ease in installation the side 54*b* of filler piece 54 which is to be installed adjacent surface 22*a* of frame 22 may preferably have a pressure sensitive adhesive to be covered by a protective material (not shown). Preparatory to installation, the protective material is stripped away. Then side 54*b* is properly aligned relative to surface 22*a* and pressure is applied to side 54*b* to cause adherence to frame 22 oriented such that side 54*a* touches surface 20*c* of screen frame 20 when screen door 18 is closed. To provide clearance for angle 48 two slots 60 (FIG. 3) are formed at appropriate places in wall 54*b* of filler piece 54.

With reference now to FIG. 5, U shaped filler piece 56 may for example be made of aluminum with leg 56*a* thereof secured to surface 22*a* by a suitable adhesive or threaded fasteners or rivets as appropriate. Leg 56*b* is sized such that leg 56*c* makes an insect tight seal with surface 20*b* of screen frame 20. That is, leg 56*b* is typically the same width as the distance between door 16 surface 22*a* and a line parallel thereto through wall 34.

On site installation of the hingable screen door assembly is as follows. First screen door 18 is installed in its conventional location, that is between walls 32 and 34 and positioned all the way to the right as illustrated in FIG. 2 such that the door frame 20 touches wall 26 of frame section 12*c*. Then the door is moved to the left about 0.6 centimeters to provide for clearance in the final assembly and a line is scribed on surface 22*a* along the left edge of the screen door frame. The line is not illustrated in any of the figures as it is a covered by filler piece 54 as described below. Next the screen door is removed and its rollers (not shown) are removed therefrom and discarded.

Then the upper filler piece 54′ (FIG. 3) is marked and cut to fit around walls 32 and 34 of frame section 12*a* and the upper filler piece 54′ is secured to surface 22*a* with the left edge of side 54*b* thereof along the scribed line. Lower filler piece 54″ is similarly marked, cut and installed with the left edge of side 54*b* also along the scribed line. Next the members 48 are positioned through openings 60 (FIG. 3) such that leg 48*a* thereof is to the left of (as illustrated in FIG. 4) and touching filler piece 54 and leg 48*b* is touching surface 22*a*. Then markings are made through existing holes in leg 48*b* onto surface 22*a* and the holes are drilled. Next members 48 are secured to frame 22 by suitable fasteners. Hinge sections 44 are next loosely secured to legs 48*a* of members 48. Then screen door 18 is temporarily positioned in its closed position clear of wall 26 of frame sections 12*a* and 12*c* and clear of frame section 12*d* while touching the outside of frame walls 34 of frame sections 12*a* and 12*c* and also touching side 54*a* of filler piece 54. Next marks are made on screen frame 20 in line with holes in hinge section 42. Frame 20 is drilled and hinge section 42 is attached thereto and the hinge sections 44 are tightly secured to legs 48*a*.

Notches 66 (FIG. 3) may have to be cut in material 54 to permit clearance for hinge piece 42 if the installation requires that screen door 18 be positioned closer to door 16 than the width of the filler piece. If a separate spring 52 (FIG. 2) is used it is attached to the screen frame 20 and the sliding glass door frame 22. If the screen door tends to sag after installation, a commercially available anti-sag mechanism 70 is installed (FIG. 1).

Any gap between the bottom of door frame 20 and frame section 12*d* is eliminated by the addition of a gap filling material 72 (FIG. 1) to the bottom of door frame 20.

It will be understood that the screen door hinging assembly comprises hinges 40, L shaped members 48 (if used), filler piece 54 or 56 and the necessary hardware to install hinges 40 and member 54 or 56. The hinging assembly may also comprise any or all of spring 52, anti-sag mechanism 70 and filler piece 72.

It will be further understood that although fixed door panel 16 is illustrated against frame section 12*b*, it also may be positioned against frame section 12*c* with screen door 18 then positioned between door 16 and frame section 12*b*.

Installation of the hinges and filler piece in FIG. 5 is similar to that of FIG. 4 except that at least part of the installation would likely be performed at a door structure factory. In particular filler piece 56 will typically be cut to fit between frame sections 12*a* and 12*d* and the holes would be predrilled in door 16 surface 22*a* and screen door frame surface 20*a*.

What is claimed is:

1. Apparatus for hingedly mounting a screen door to a sliding glass door structure wherein said structure comprises a frame including at least one guide track and first and second glass door panels, said first panel slidable along said one track, said second panel fixed relative to said frame parallel to said track when operative, said apparatus comprising in combination:

means adapted for attachment to said screen door and to said second door panel for permitting said screen door to pivot relative to said second door panel between a first position abutting said frame and a second position removed therefrom; and means for substantially sealing any gap between said second door panel and said screen door when said screen door is in said first position.

2. The combination as set forth in claim 1 wherein said attachment means comprises a pair of hinges each comprising two sections pivotable relative to one another with one of said hinge sections adapted for attachment to said screen door and the other of said hinge sections adapted for attachment to said second door panel.

3. The combination as set forth in claim 1 further including means for resiliently urging said screen door toward said first position.

4. The combination as set forth in claim 2 further including means for resiliently urging said screen door toward said first position.

5. The combination as set forth in claim 2 wherein said pair of hinges includes means for adjusting the distance between said screen door and second door panel.

6. The combination as set forth in claim 1 wherein said sealing means comprises an elongated member being one of generally L shaped and generally U shaped having one leg adapted for mounting to said second panel and another leg adapted for contacting said screen door along one side corner thereof.

7. The combination as set forth in claim 4 wherein said sealing means comprises an elongated member being one of generally L shaped and generally U shaped having one leg adapted for mounting to said second panel and another leg adapted for contacting said screen door along one side corner thereof.

8. The combination set forth in claim 6 further including an adhesive on one of said legs for permitting attachment to said second panel.

9. The combination set forth in claim 7 further including an adhesive on one of said legs for permitting attachment to said second panel.

10. The combination as set forth in claim 6 wherein said elongated member comprises a vinyl material.

* * * * *